United States Patent [19]

Sugimoto et al.

[11] 4,013,845

[45] Mar. 22, 1977

[54] TEMPERATURE COMPENSATING REPRODUCING SYSTEM

[75] Inventors: Yukio Sugimoto, Katano; Makoto Okamasa, Kyoto; Toyoshi Fukumura, Neyagawa, all of Japan

[73] Assignee: Matsushita Electric Industrial Co., Ltd., Osaka, Japan

[22] Filed: Apr. 24, 1974

[21] Appl. No.: 463,668

[30] Foreign Application Priority Data

Apr. 25, 1973 Japan ..... 48-48029
May 15, 1973 Japan ..... 48-54409

[52] U.S. Cl. ..... 179/100.41 R; 179/100.4 A
[51] Int. Cl.[2] ..... H04R 1/16
[58] Field of Search ..... 179/100.4 A, 100.41 K, 179/100.41 Z, 100.41 P, 100.41 B, 100.41 R, 100.41 V

[56] References Cited

UNITED STATES PATENTS

| | | | |
|---|---|---|---|
| 2,037,255 | 4/1936 | Miller | 179/100.41 R |
| 2,336,241 | 12/1943 | Gravley et al. | 179/100.41 R |
| 2,516,393 | 7/1950 | Kalmus | 179/100.41 Z |
| 3,624,314 | 11/1971 | Mantor | 179/100.4 A |

*Primary Examiner*—Jay P. Lucas
*Attorney, Agent, or Firm*—Stevens, Davis, Miller & Mosher

[57] ABSTRACT

A record reproducing system comprising a displacement detection type cartridge and a reproducing circuit for converting the output signal of the displacement detection type cartridge into audio signals. Either the displacement detection type cartridge or a pre-amplifier in the reproducing circuit is provided with a temperature sensitive resistive element so that temperature compensation with respect to the output-temperature characteristic of the displacement detection type cartridge may be effected at either the displacement detection type cartridge or the reproducing circuit.

3 Claims, 11 Drawing Figures

TEMPERATURE COMPENSATING REPRODUCING SYSTEM

This invention relates to record reproducing systems using a commonly termed displacement detection type cartridge such as a crystal cartridge, ceramic cartridge or semiconductor cartridge for converting mechanical displacement into a corresponding electric signal.

Figure 1:
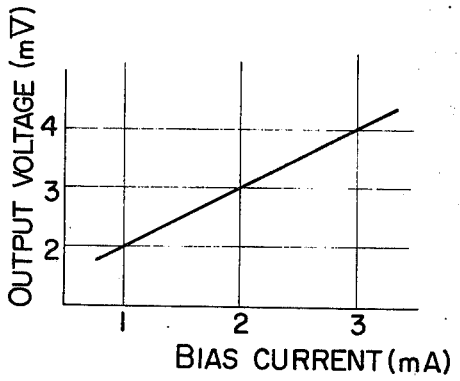
FIG. 1 is a graph representing an output voltage versus bias current characteristic of a displacement detection type cartridge.
Figure 2:
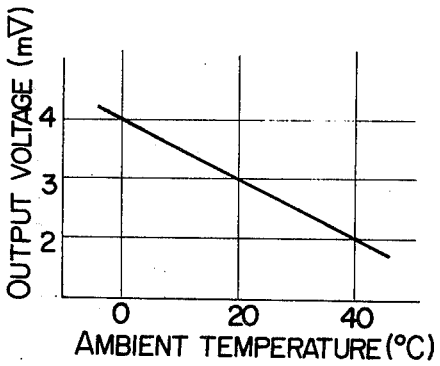
FIG. 2 is a graph representing an output voltage versus ambient temperature characteristic of a displacement detection type cartridge.

In a displacement detection type cartridge, particularly a semiconductor cartridge, the bias current is adapted to change according to vibrations of the pick-up needle tip, thereby providing a corresponding changing output voltage. A typical relation between output voltage and bias current is shown in FIG. 1. The vibrations of the pick-up needle tip are transmitted by a transmitting element made of a resilient material such as rubber. Therefore, as the ambient temperature changes the resiliency of the vibration transmitting element changes to change the output voltage level, as shown in FIG. 2. For example, with an increase in ambient temperature the resiliency of the vibration transmitting element increases to reduce changes of the bias current representing the vibrations of the pick-up needle tip, thus reducing the output level.

In this type of displacement detection cartridge, with a change in the resiliency of the vibration transmitting element of a resilient material such as rubber due to an ambient temperature change, the braking force of the transmitting element changes to greatly change the output signal level.

Where such displacement detection type cartridge is used in an ordinary two-channel stereo record reproducing system, the sound output may be increased by adjusting a volume control since the output levels of both the left and right channels change with ambient temperature at the same rate. However, in a discrete type reproduction system such as the CD-4 type four-channel stereophonic record reproduction, although the reproduced frequency modulated sub-channel signal level is unaffected by changes of the resiliency of the vibration transmitting element due to changes of ambient temperature, the reproduced main channel signal level changes with ambient temperature. This means that the separation of front and rear signals changes with ambient temperature.

In light of the above, the present invention is predicated on the provision of a record reproducing system, which is excellent as a whole, and in which the output characteristic of the aforesaid displacement detection type cartridge is compensated for ambient temperature changes reliably and with simple means.

An object of the invention is to provide for the compensation of the output characteristic of the displacement detection type cartridge for ambient temperature changes by means of a temperature sensitive resistive element provided in the reproducing circuit for converting the output signal of the displacement detection type cartridge into audio signals.

Another object of the invention is to provide for compensation of bias current in the displacement detection type cartridge for ambient temperature changes by using a temperature sensitive resistive element in the bias circuit in the displacement detection type cartridge.

A further object of the invention is to prevent deterioration of the separation of front and rear signals in the four-channel stereophonic record reproduction due to a difference in level between main channel and sub-channel signals resulting from a change of ambient temperature by using a temperature sensitive resistive element in the main channel signal processing circuit of the reproducing circuit for reproducing audio signals from the output of the displacement detection type cartridge.

An embodiment of the record reproducing system according to the invention will now be described with reference to the drawings.

Figure 3:
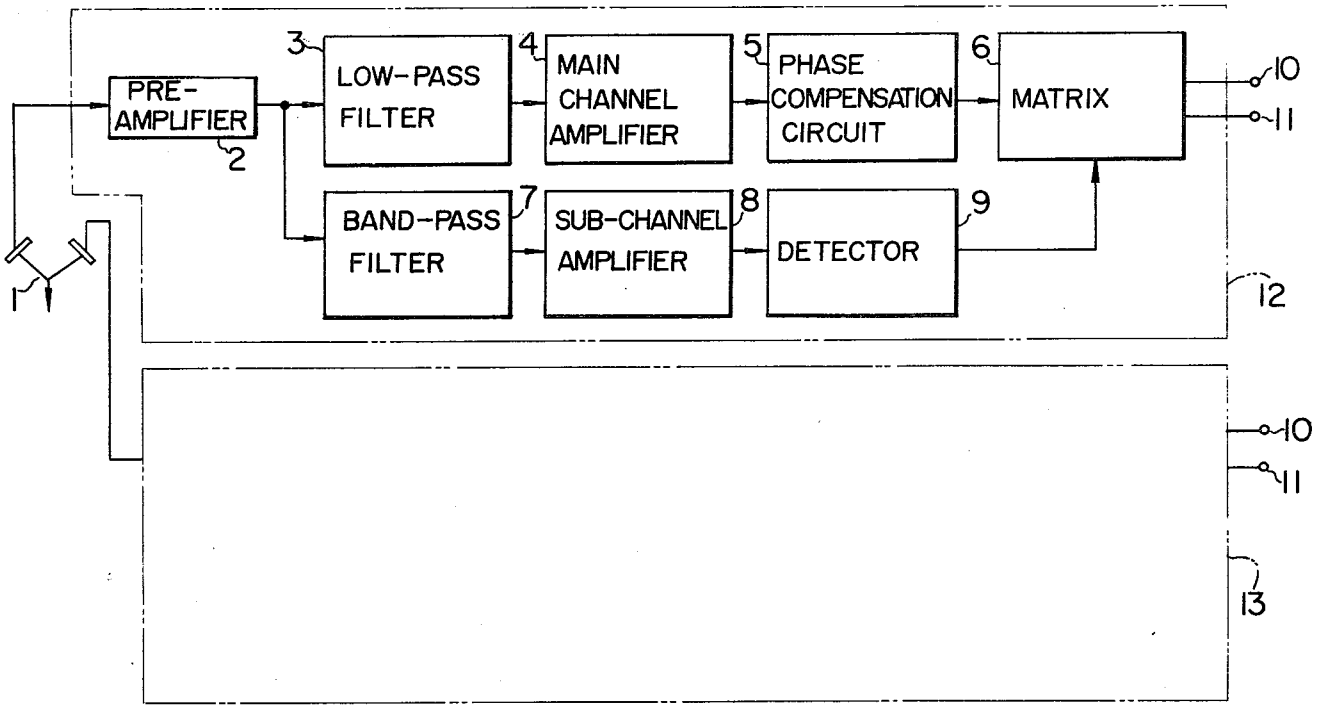
FIG. 3 is a block diagram of a CD-4 type four-channel stereo record reproducing system embodying the invention.

FIG. 3 is a block diagram of a record reproducing system for CD-4 type reproduction of four-channel records. In the Figure, numeral 1 designates a displacement detection type cartridge, numeral 2 a pre-amplifier, numeral 3 a low-pass filter for deriving the main channel signal, numeral 4 a main channel signal amplifier, numeral 5 a phase compensation circuit, numeral 6 a matrix circuit, numeral 7 a band-pass filter for deriving the sub-channel signal, numeral 8 a sub-channel signal amplifier for amplifying the sub-channel signal and having a function of limiting the amlitude, numeral 9 a detector, and numerals 10 and 11 output terminals of the matrix circuit 6. Numeral 12 generally designates the left signal reproducing section, and numeral 13 the right signal reproducing section. The right signal reproducing section 13 has the same circuit construction as the left signal reproducing section 12, and is not shown in detail.

Figure 4:
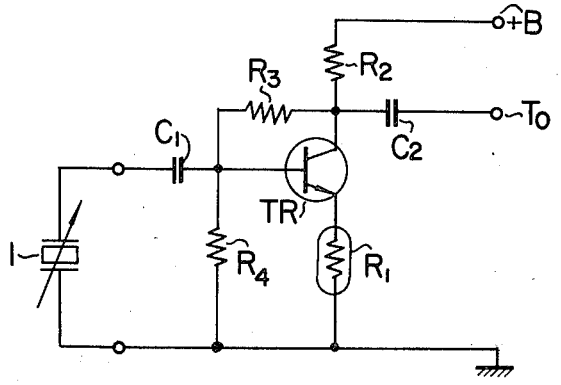
FIG. 4 is an electric circuit diagram showing a specific example of the pre-amplifier in the same system.

FIG. 4 shows an example of the pre-amplifier 2 employed in the above record reproducing system. It has an amplifying transistor TR having the emitter connected to ground through a temperature sensitive resistive element $R_1$, whose resistance reduces with increasing temperature, the collector connected through a resistor $R_2$ to a supply voltage terminal +B and the base connected through a capacitor $C_1$ to the displacement detection type cartridge 1. The collector is also connected through a capacitor $C_2$ to an output terminal $T_0$. Resistors $R_3$ and $R_4$ serve to determine the base bias voltage.

In the above construction of the record reproducing system, a four-channel stereophonic composite signal detected by the displacement detection type cartridge 1 is amplified by the pre-amplifier 2 in each of the left and right signal reproducing sections. The output of the pre-amplifier 2 is coupled to the filters 3 and 7 for separating the main and sub-channel signals. The main channel signal is a sum combination of front and rear signals, and it is amplified through the amplifier 4, whose output is phase compensated through the phase compensation circuit 5, whose output is then added to the matrix circuit 6. The sub-channel signal is a frequency modulation of a sub-carrier wave with a difference combination of the front and rear signals, and it is amplified through the amplifier 8, whose output is in turn coupled through the detector 9 to the matrix circuit 6. Thus, separated front and rear signals appear at the respective output terminals 10 and 11 of the matrix circuit 6. More particularly, left front and rear signals appear at the respective output terminals 10 and 11 in the left signal reproducing section 12, while right front and rear signals appear at the respective output terminals 10 and 11 in the right signal reproducing section 13.

Here, the temperature sensitive resistive element $R_1$ in each pre-amplifier is very important. Unless it is provided, with increase of ambient temperature the output level of the pre-amplifier 2 is reduced due to the output-temperature characteristic of the displacement detection type cartridge 1, thus resulting in deteriorated separation of the front and rear signals. This results because of the fact that although the sub-channel signal is derived independent of the output level of the pre-amplifier 2 (for it is a frequency modulated signal) the level of the main channel signal is reduced with decrease in the preamplifier output level. With decrease of the main channel signal level, a difference in level results in the two inputs to the matrix circuit, so that the separation of the front and rear signals is extremely deteriorated. In the above embodiment, as the ambient temperature is increased to reduce the output level of the displacement detection type cartridge 1, the temperature sensitive resistive element $R_1$ provided in the pre-amplifier 2 shown in FIG. 2 functions to provide an increased reverse bias between the base and emitter of the transistor TR so that the amplification degree thereof is increased. In consequence, irrespective of ambient temperature changes the output level of the pre-amplifier 2 is constant, and the separation of front and rear signals is not deteriorated.

As has been shown, according to the invention the output-temperature characteristic of the cartridge can be perfectly compensated by the output-temperature characteristic of the pre-amplifier, so that the record reproducing system as a whole may have excellent performance immune to changes in ambient temperature.

Figure 5:
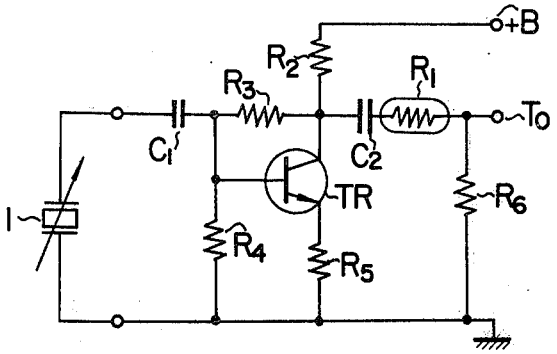
FIGS. 5 and 6 are electric circuit diagrams showing other examples of the pre-amplifier in the same system.
Figure 6:
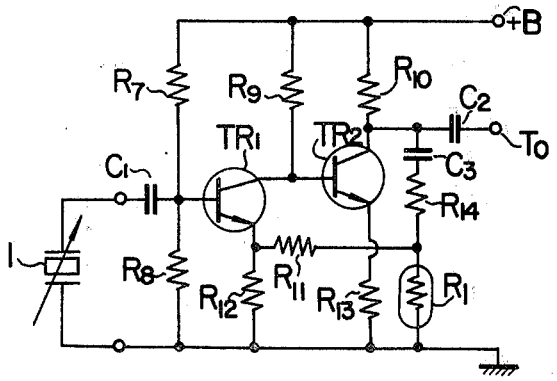

FIGS. 5 and 6 show other examples of the preamplifier 2. In the example of FIG. 5, the temperature sensitive resistive element $R_1$ is connected between capacitor $C_2$ and output terminal $T_0$, with the emitter of the transistor TR grounded through a resistor $R_5$ and the output terminal $T_0$ grounded through a resistor $R_6$. The example of FIG. 6 has two amplifier stages constituted by respective transistors $TR_1$ and $TR_2$, with a series circuit of resistors $R_{11}$ and $R_{14}$ and capacitor $C_3$ provided between the emitter of the transistor $TR_1$ and the collector of the transistor $TR_2$. In this example, the temperature sensitive resistive element $R_1$ is connected between the juncture between the resistors $R_{11}$ and $R_{14}$ and ground. In FIG. 6, $R_7$, $R_8$ and $R_9$ designate base bias resistors, $R_{10}$ a collector load resistor, and $R_{12}$ and $R_{13}$ emitter load resistors. In FIGS. 5 and 6, like parts as in FIG. 4 are designated by like reference symbols.

While in the above embodiment the temperature sensitive resistive element $R_1$ is provided in the preamplifier 2, it is also possible to incorporate this element in the main channel signal processing circuit in the reproducing system.

Figure 7:
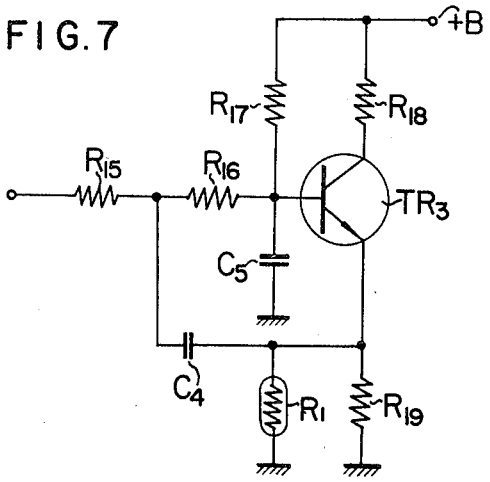
FIG. 7 is an electric current diagram showing a low-pass filter in another embodiment of the invention applied to a CD-4 type four-channel stereo record reproducing system.

FIG. 7 shows an embodiment where the temperature sensitive resistive element $R_1$ is used in the low-pass filter 3, which includes a transistor $TR_3$, resistors $R_{15}$ and $R_{16}$ and capacitors $C_4$ and $C_5$. In the Figure, $R_{17}$, $R_{18}$ and $R_{19}$ are resistors respectively connected to the base, collector and emitter of the transistor $TR_3$. The temperature sensitive resistive element $R_1$ may further be used in amplifier 4 and phase compensation circuit 5 constituting the main channel signal processing circuit.

Further, while the above embodiments are concerned with the CD-4 type four-channel record reproducing system, the invention may also be applied to ordinary two-channel stereophonic or monaural (single channel) record reproducing systems.

Moreover, instead of providing the temperature sensitive resistive element $R_1$ on the side of the circuit for converting the output signal of the displacement detection type cartridge 1 into audio signals of individual channels, similar effects may be obtained by providing it on the side of the displacement detection type cartridge 1.

Figure 8:
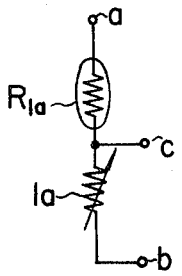
FIG. 8 is an electric circuit diagram of a displacement detection type cartridge in a further embodiment of the record reproducing system according to the invention.

FIG. 8 shows an electric circuit diagram of another embodiment, in which a temperature sensitive resistive element is used on the side of the displacement detection type cartridge. In the Figure, designated at 1*a* is a semiconductor cartridge constituted by a silicon tip, whose internal resistance is adapted to be changed as vibrations of a pick-up needle tip are transmitted to it through a vibration transmitting element made of a resilient material such as rubber. In this embodiment, a temperature compensation thermistor $R_{1a}$ (temperature sensitive resistive element) is connected in series with the semiconductor cartridge 1*a*. Here, the bias voltage for the semiconductor cartridge 1*a* is applied between the opposite terminals *a* and *b* of the series circuit of thermistor $R_{1a}$ and semiconductor cartridge 1*a*, and the output of the cartridge 1*a* is taken out from between the opposite terminals *c* and *b* of the cartridge 1*a*.

In this construction, the thermistor $R_{1a}$ has such a resistance-temperature characteristic that with increase of ambient temperature its internal resistance reduces to increase the bias current to the semiconductor cartridge 1*a*. Thus, if the physical force which acts on the semiconductor cartridge by the vibration transmitting element transmitting the vibrations of the pick-up needle tip is decreased with increase in the elasticity of the vibration transmitting element due to an increase of ambient temperature, the output voltage level of the cartridge is substantially the same as that before the increase of the ambient temperature. Since the output-temperature characteristic of the cartridge 1*a* is compensated in this way, the effect of changing temperature can be eliminated. If the ambient temperature is reduced, the internal resistance of the thermistor $R_{1a}$ is increased to reduce the bias current to the semiconductor cartridge 1*a*. Thus, in this case the output voltage level of the cartridge is also substantially the same as that before the decrease of the ambient temperature.

Figure 9:
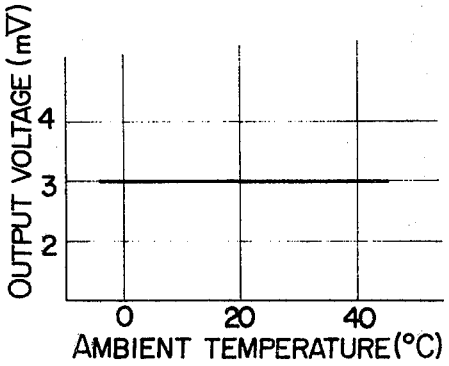
FIG. 9 is a graph showing an output voltage versus ambient temperature characteristic of the displacement detection type cartridge of FIG. 8.

FIG. 9 shows the output-temperature characteristic of this semiconductor cartridge 1*a*, the output voltage being totally unaffected by ambient temperature changes.

Figure 10:
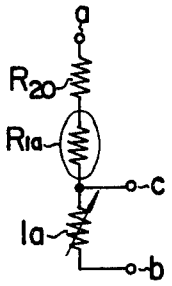
FIGS. 10 and 11 are electric circuit diagrams showing modifications of the displacement detection type cartridge of FIG. 8.
Figure 11:
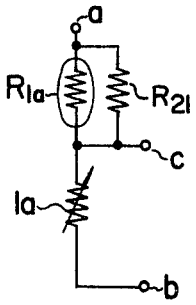

FIGS. 10 and 11 show other displacement detection type cartridges embodying the invention. In the embodiment of FIG. 10, a resistor $R_{20}$ for setting bias current is connected in series with the series circuit of semiconductor cartridge 1*a* and thermistor $R_{1a}$. In the embodiment of FIG. 11, a resistor $R_{21}$ for setting bias current is connected in parallel with the thermistor $R_{1a}$. In these embodiments, similar effects as mentioned in connection with the previous embodiment of FIG. 8 can be obtained.

In the above three embodiments it has been described that the thermistor $R_{1a}$ is provided to compensate for changes of the vibration transmitting characteristic of the transmitting element for transmitting vibrations of the pick-up needle tip to the silicon tip with temperature, but it is also possible to apply the thermistor for compensation inclusive of the compensation of the elasticity-temperature characteristic of the elastic support such as a canti-lever.

Also, in place of the thermistor $R_{1a}$ for temperature compensation an element having an opposite output-temperature characteristic may be connected in parallel with the semiconductor cartridge 1a to obtain similar compensation of the output voltage of the cartridge for temperature changes.

As has been described in the foregoing, according to the invention the output-temperature characteristic of the displacement detection type cartridge whose output level is subject to changes with ambient temperature can be compensated by providing in the cartridge or in the amplifier circuit a temperature sensitive resistive element whose internal resistance changes with temperature. Thus, it is possible with a simple circuit construction to hold the output voltage level of the displacement detection type cartridge constant irrespective of changes of the ambient temperature. Particularly, when applied to CD-4 type or discrete type record reproducing systems it is possible to prevent deterioration of separation of front and rear signals due to a difference in level between main channel and sub-channel signals resulting from a change in ambient temperature. Thus, reliable record reproduction can be steadily ensured, which is greatly beneficial in industry.

What we claim is:

1. A record reproducing system comprising a displacement detection type cartridge, said cartridge being provided with a bias current and producing an output signal having a magnitude which varies inversely with changes in ambient temperature; a reproducing circuit for converting said output signal into audio signals; and a bias circuit interposed between said cartridge and said reproducing circuit for varying the bias current of said cartridge in a direct relationship with changes in ambient temperature, said bias circuit including a temperature sensitive element having an electrical resistance which varies inversely with changes in the ambient temperature thereby compensating for the temperature characteristic of said cartridge and producing an output voltage which is substantially independent of changes in ambient temperature.

2. A record reproducing system according to claim 1, wherein said bias circuit comprises a series circuit consisting of a bias current setting resistor and said temperature sensitive resistive element.

3. A record reproducing system according to claim 1, wherein said bias circuit consists of a parallel circuit consisting of a bias current setting resistor and said temperature sensitive resistive element.

* * * * *